US006115879A

United States Patent [19]

Mitchell

[11] Patent Number: 6,115,879

[45] Date of Patent: Sep. 12, 2000

[54] VACUUM CLEANER

[76] Inventor: Carl Mitchell, 239 Mitchell Avenue, Oshawa, Ontario, Canada

[21] Appl. No.: 09/323,212

[22] Filed: Jun. 1, 1999

[51] Int. Cl.[7] ..... A47L 9/12

[52] U.S. Cl. ..... 15/327.7; 15/327.5; 15/347; 55/488

[58] Field of Search ..... 15/327.1, 327.5, 15/327.7, 344, 347; 55/487, 488, 521, DIG. 3; 294/1.3, 64.1

[56] References Cited

U.S. PATENT DOCUMENTS

| | | | |
|---|---|---|---|
| 1,084,933 | 1/1914 | Feeny | 15/344 |
| 1,558,006 | 10/1925 | Fisker | 15/344 |
| 2,537,965 | 1/1951 | Cantin | 55/521 |
| 2,668,315 | 2/1954 | Crosby | 15/344 |
| 2,761,529 | 9/1956 | Wisenbaugh | 55/487 |
| 2,910,717 | 11/1959 | Raymond | 15/339 |
| 4,185,355 | 1/1980 | Williams | 15/344 |
| 4,297,116 | 10/1981 | Cusick | 55/487 |
| 5,040,263 | 8/1991 | Guhne et al. | 15/327.5 |
| 5,661,873 | 9/1997 | Karet | 15/344 |
| 5,771,531 | 6/1998 | Swartz | 15/344 |

*Primary Examiner*—Terrence R. Till

[57] ABSTRACT

The vacuum cleaner includes a hollow canister, one end of which is closed by a removable cap to permit removal of debris from within the interior. The canister is separated into two compartments, one defined by the first end and a hollow rigid conical filter disposed in the interior. The filter has a base adjacent to the inner wall throughout its extent and tapers toward the second end of the canister. The filter further has openings too small to allow debris such as cigarette and cigar butts, excrement of animals and birds and the like to pass therethrough but large enough to allow smaller debris to pass. A second compartment is defined by the filter and a relatively flat filter having openings smaller than that of the conical filter. Both filters extend across the interior such that all air which travels through the interior must pass through the filters. An intake hose admits debris-laden air into the first compartment and an exhaust discharges air from the second compartment. Suction means causes air to flow from the inlet of the tube, through the interior and to exit through the exhaust.

5 Claims, 2 Drawing Sheets

VACUUM CLEANER

BACKGROUND OF THE INVENTION

This invention relates to vacuum cleaners which are suitable for picking up particles which are normally too large to be picked up by conventional vacuum cleaners. The particles may be composed of, for example, excrement of animals and birds, pine cones, twigs and pieces of bark. More particularly the invention relates to vacuum cleaners having conical filters for use in picking up relatively large particles such as those mentioned above.

Vacuum cleaners are known which have conical filters. Such filters have the advantage over flat filters in that they have a larger effective filtering surface for a given area through which air to be filtered passes. Examples of such vacuum cleaners are described in such U.S. patents as no. 2,719,596 to Kent et al.; U.S. Pat. No. 3,910,781 to Bryant; U.S. Pat. No. 5,287,591 to Rench et al.; U.S. Pat. No. 5,305,495 to Nelsen et al.; U.S. Pat. No. 5,307,538 to Rench et al.; and U.S. Pat. No. 5,593,479 to Frey et al.

Vacuum cleaners such as those referred to above are suitable for picking up relatively small particles such as dust and dirt but have limited or no usefulness where the particles are larger. Larger particles quickly clog the machines and render them useless after a short period of time. In addition vacuum cleaners typically have cloth or paper bags in which the particles are collected. Such bags are not suitable for larger particles because they tend to rip or to become clogged by such particles. In addition they burn if the vacuum cleaner picks up cigarette or cigar butts that are still burning.

SUMMARY OF THE INVENTION

The vacuum cleaner of the present invention is intended specifically for picking up larger particles such as cigarette and cigar butts, excrement of animals and birds, twigs, pine cones and the like. The vacuum cleaner may be constructed so that it is portable and, being portable, it is useful for removing debris such as that mentioned above from parks, golf courses, fair grounds and wherever else such debris is a problem.

The vacuum cleaner of the invention includes a canister having first and second ends and a hollow interior defined by an inner wall. The first end is closed by a removable cap to permit removal of debris from within the interior. The canister is separated into a plurality of compartments. A first compartment is defined by the first end and a hollow rigid conical filter disposed in the interior. The filter has a base adjacent to the inner wall throughout its extent and tapers toward the second end of the canister. The filter further has openings too small to allow debris such as cigarette and cigar butts, excrement of animals and birds and the like to pass therethrough but large enough to allow smaller debris to pass. A second compartment is defined by the filter and a relatively flat filter having openings smaller than that of the conical filter. Both filters extend across the interior such that all air which travels through the interior must pass through the filters. An intake hose admits debris-laden air into the first compartment and an exhaust discharges air from the second compartment. Suction means causes air to flow from the inlet of the tube, through the interior and to exit through the exhaust.

DESCRIPTION OF THE DRAWINGS

The vacuum cleaner of the invention is described in detail with reference to the accompanying drawings in which.

Figure 1:
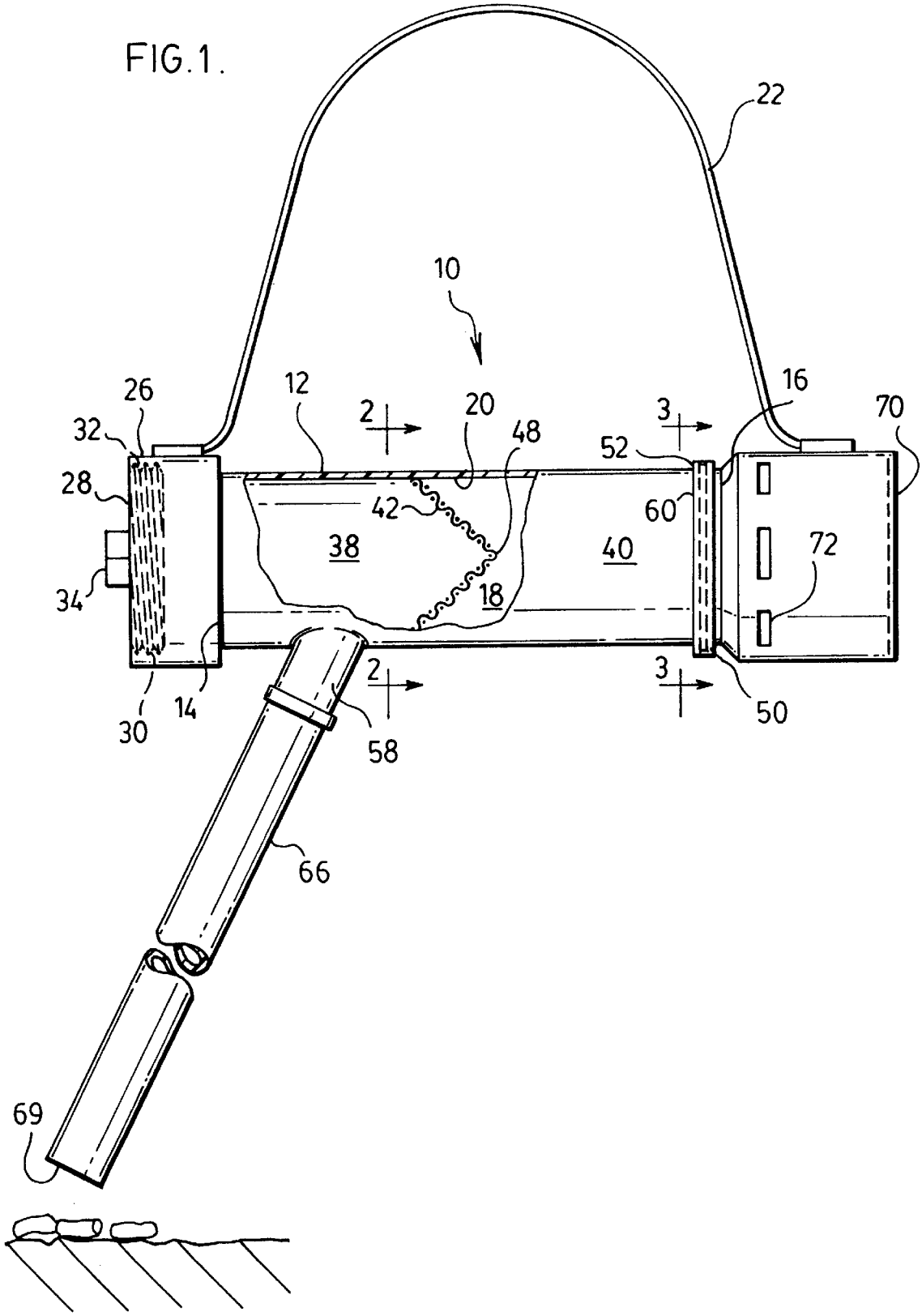
FIG. 1 is an elevation, partly cut away, of the vacuum cleaner.

FIG. is a section on line 2—2 of FIG. 1; and

Figure 3:
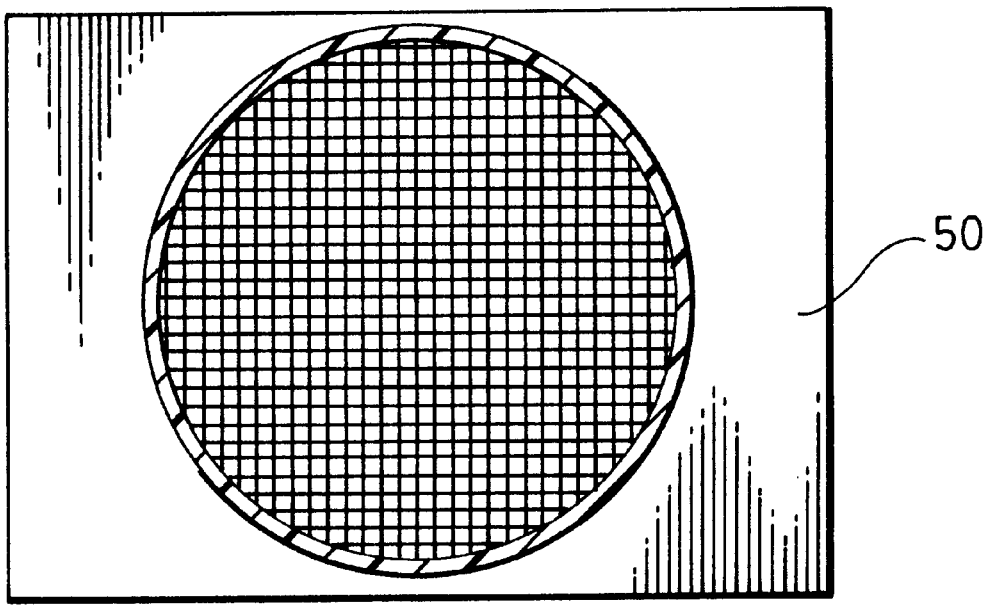

FIG. 3 is a section on line 3—3 of FIG. 1.

Like reference characters refer to like parts throughout the description of the drawings.

DESCRIPTION OF PREFERRED EMBODIMENTS

With reference to FIG. 1, the vacuum cleaner of the invention, generally 10, has a central cylindrical canister 12 which is preferably a two to three feet length of standard polymeric pipe of approximately four inches in diameter. The canister has first and second ends 14, 16 and a hollow interior 18 defined by an inner wall 20. A strap 22 is connected to the canister. The strap goes over the shoulder of the person who is carrying the vacuum cleaner so that his hands will be free as he operates the machine.

The first end 14 of the canister has a sleeve 26 attached to its outer wall. The sleeve is closed by a removable cap 28 to permit removal of debris from within the interior. The cap is circular in cross section and has threads 30 formed on its periphery. The threads mate with threads 32 formed on the inner wall 20 of the sleeve and a hexagonal extension or nut 34 is formed on the outside wall of the cap to facilitate attachment and removal of the cap by means of a wrench or other tool.

The canister is separated into first and second compartments 38, 40 by filters. The first compartment is defined by the inner wall of the cap, the inner wall of the canister and a hollow rigid conical filter 42.

Figure 2:
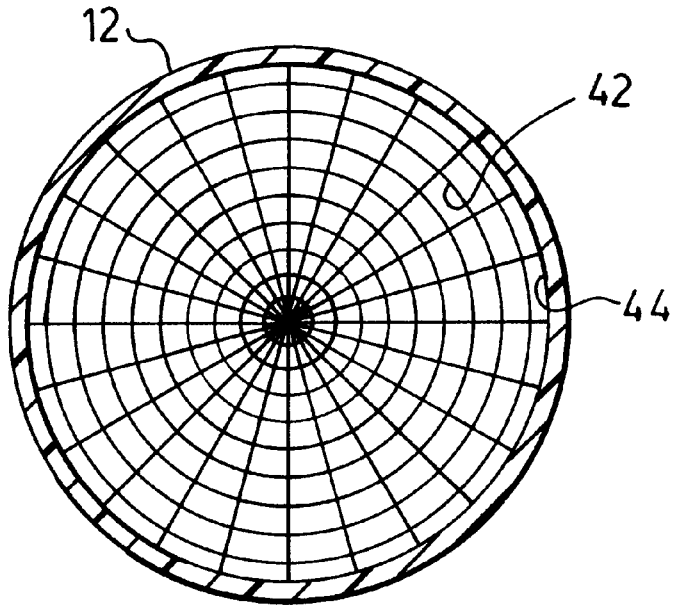

With reference to FIGS. 1 and 2, filter 42 has a base 44 which is adjacent to the inner wall 20 of the canister throughout the extent of its outer edge 46. The filter tapers toward the second end 16 and terminates at a point 48. The size of the openings in the filter is chosen to suit the debris which the vacuum cleaner is to be used to pick up. In most cases a mesh having openings of about ⅛th inch in size is suitable but where too much debris is passing through the filter a mesh having smaller openings may be more suitable.

The second compartment 40 is defined by the conical filter and by a generally flat filter 50 and with reference to FIG. 3, it extends to the inner wall. There is a opening 52 through which the filter may be withdrawn from the canister so that. it can be cleaned or exchanged for a clean filter. A hinged cover (not illustrated) is provided so that the opening can be closed when the vacuum cleaner is in use.

The flat filter need not be circular. It can be rectangular such as a conventional filter for a furnace. With reference to FIG. 3, filter 50 is partly within the interior of the canister and partly outside it. A jacket 60 is attached to the outside wall of the canister for receipt of the portions of the flat filter outside the canister. The jacket has an opening through which the flat filter may be introduced into the canister for use and withdrawn from the canister for cleaning or replacement. A cover (not illustrated) is connected to the jacket by a hinge for selective opening and closing of the opening.

A filter sold under the trade mark WEB-PRO by Web Products Inc. of Kansas City, Kans. is suitable for use as filter 50.

Both filters 42, 50 extend across the interior of the canister so that all particle-laden air which travels through the interior must pass through both filters. As indicated above, the mesh size of the filters is selected such that it prevents all particles of a size most likely to be encountered in the intended vacuuming operation from passing though the screens but does not restrict the flow of air.

The largest particles will be larger than the openings in the conical screen 42 and finer particles which pass through that screen are caught by the second screen. Particles caught by the conical screen fall to the bottom of the canister when it is held horizontal and they may be removed by opening cap 28. The opening through which the flat filter is inserted and removed may be used to remove the fine particles caught by that filter.

An intake hose or pipe 66 is connected to a juncture 58 which opens into the first compartment. If the intake is a pipe preferably its longitudinal axis and that of the canister is about 45 degrees. Preferably the hose or pipe is approximately two inches in diameter. The lower end of the pipe or hose is open at 69 and that end serves as the intake nozzle of the vacuum cleaner.

A housing 70 is mounted to the second end of the canister for receipt of a conventional suction blower or fan (not illustrated) for drawing air through the vacuum cleaner. Where the vacuum cleaner is to be used outside to pick up debris from the ground, it is generally more suitable to power it by an internal combustion engine than by an electric motor. However the blower is powered, the means for doing so can also be mounted in the housing.

The blower or fan serves to create an air stream which moves at high speed into the intake nozzle, upwardly through the canister, into the fan or blower. One or more openings 72 are formed on the housing through which air is exhausted from the second or final compartment. If desired one or more additional filters may be accommodated in the canister. Those filters can be of the same construction as filter 50 and will serve to divide the canister into additional compartments.

It will be understood of course that modifications can be made in the preferred embodiments illustrated and described herein without departing from the scope and purview of the invention as defined in the appended claims.

I claim:

1. A vacuum cleaner for picking up relatively large debris such as cigarette and cigar butts, excrement of animals and birds comprising: a canister having a closed first end, a second end and a hollow interior defined by an inner wall, said canister being separated into a plurality of compartments, a first compartment being defined by said first end and a hollow rigid conical filter disposed in the interior, said filter having a base adjacent to the inner wall throughout its extent and tapering toward the second end of the canister, said filter further having openings too small to allow the majority of said debris to pass therethrough, means for removal of debris from said first compartment, a second compartment being defined by said filter and a relatively flat filter having openings smaller than that of said conical filter, both said filters extending across the interior such that all air which travels through the interior must pass through said filters; an intake hose for admitting debris-laden air into the first compartment; an exhaust for discharging air from the second compartment; and suction means for causing air to flow from the inlet of the tube, through the interior and to exit through the exhaust.

2. The vacuum cleaner as claimed in claim 1 wherein said canister has an opening through which the flat filter may be withdrawn from the canister for cleaning or replacement.

3. The vacuum cleaner as claimed in claim 1 wherein said flat filter is rectangular and is accommodated partly within the interior of said canister And partly outside it, said vacuum cleaner further having a jacket attached to the exterior of the canister for receipt of the portions of said flat filter exterior of said canister, said jacket having an opening through which the flat filter may be inserted into and withdrawn from the canister and jacket.

4. The vacuum cleaner as claimed in claim 1 wherein the openings of said conical filter are about ⅛th of an inch in size.

5. A vacuum cleaner for picking up relatively large debris such as cigarette and cigar butts, excrement of animals and birds comprising: a canister having first and second ends and a hollow interior defined by an inner wall, said first end being closed by a removable cap to permit removal of debris from within the interior; said canister being separated into a plurality of compartments, a first compartment being defined by said first end and a hollow rigid conical filter disposed in the interior, said filter having a base adjacent to the inner wall throughout its extent and tapering toward. the second end of the canister, said filter further having openings too small to allow debris such as cigarette and cigar butts, excrement of animals and birds to pass therethrough but large enough to allow smaller debris to pass, a second compartment being defined by said filter and a relatively flat filter having openings smaller than that of said conical filter, said filters extending across the interior such that all air which travels through the interior must pass through said filters; an intake hose for admitting debris-laden air into the first compartment; an exhaust for discharging air from the second compartment; and suction means for causing air to flow from the inlet of the tube, through the interior and to exit through the exhaust.

* * * * *